United States Patent [19]

Bowmer et al.

[11] Patent Number: 5,067,844

[45] Date of Patent: Nov. 26, 1991

[54] REINFORCING BAR COUPLER

[75] Inventors: Geoffrey M. Bowmer, Oisterwijk, Netherlands; John E. Groth, Cleveland Heights, Ohio

[73] Assignee: Erico International Corporation, Solon, Ohio

[21] Appl. No.: 101,633

[22] Filed: Sep. 28, 1987

[51] Int. Cl.[5] ..... F16B 7/18

[52] U.S. Cl. ..... 403/305; 403/314

[58] Field of Search ..... 403/307, 308, 305, 314

[56] References Cited

U.S. PATENT DOCUMENTS

| | | | |
|---|---|---|---|
| 1,712,108 | 5/1929 | Goeller | 403/305 X |
| 1,833,008 | 11/1931 | Thorpe | 403/305 |
| 2,064,440 | 12/1936 | Meeker | 403/305 X |
| 2,135,812 | 11/1938 | Gray | 403/305 |
| 2,930,642 | 3/1960 | Howlett | 403/314 |
| 3,201,158 | 8/1965 | Meripol | 403/307 |
| 3,253,332 | 5/1966 | Howlett et al. | 403/314 X |
| 3,415,552 | 12/1968 | Howlett | 403/305 |
| 3,514,140 | 5/1970 | Ely et al. | 403/305 X |
| 3,850,535 | 11/1974 | Howlett et al. | 403/305 |
| 4,047,388 | 9/1977 | Howlett | 403/305 X |

*Primary Examiner*—Peter M. Cuomo

*Attorney, Agent, or Firm*—Renner, Otto, Boisselle & Sklar

[57] ABSTRACT

A position coupler for connecting reinforcing bar in concrete construction where neither bar is able to rotate either conveniently or not at all includes a sleeve at least a portion of which is internally cylindrically threaded and which receives at least one split collar insert. The insert has external cylindrical threads which match the internal cylindrical threads of the sleeve and also has internal tapered threads which match the tapered external threads on the bars to be joined. The inserts, in addition to being longitudinally split are provided with either a transverse slot or a hex head on their outer ends to receive a wrench. When a transverse slot is provided a spanner wrench may be inserted between the bar and sleeve. The tightening of the insert creates a wedge action which hoop stresses the sleeve locking the parts together and reduces slippage. The insert may be locked anywhere along the interior of the cylindrical thread portion of the sleeve to connect bars at different axial spacings. In a preferred form the sleeve is machined from stock with the cylindrical threads receiving the insert being formed on one end while the opposite end is provided with a taper thread socket having taper threads which match the external tapered threads of the bars to be joined. In another embodiment the sleeve is formed of tube with the internal cylindrical threads extending the length of the sleeve and an insert for each bar is employed.

18 Claims, 3 Drawing Sheets

REINFORCING BAR COUPLER

This invention relates generally as indicated to a reinforcing bar coupler and more particularly to a position coupler for connecting reinforcing bar in concrete construction where neither of the bars joined need be rotated.

BACKGROUND OF THE INVENTION

In the concrete construction industry mechanical bar splicing systems are widely employed. One such splicing system utilizing taper threaded bar ends and a matching taper thread coupler is sold by Erico Products, Inc. of Solon, Ohio, U.S.A. under the trademark LENTON. Tapered threads provide superior strength in the coupling. A standard or transition coupler, the latter connecting bars of different sizes, comprises simply internally taper threaded sleeves and are designed for connections where at least one bar can be turned on its axis.

In concrete construction there are many situations where neither bar is able to rotate either conveniently or not at all. Typical such situations are where one bar is bent, where bars are secured to each other, or where bar ends are projecting from already cast or precast concrete. Also in some situations where the bars are fixed and in clusters, the spacing between the taper threaded ends of bars to be joined may vary.

In such situations couplers known as position couplers are employed. Such couplers normally comprise separate threaded couplers for each bar end and a linking sleeve which engages the respective bar couplers. Such couplers may also be used with opposite hand threads to act as turnbuckles which when tightened draw the bar ends together. Examples of several forms of position couplers may be seen in U.S. Pat. No. 3,850,535.

A conventional position coupler such as that manufactured by Erico Products, Inc. of Solon, Ohio under such trademark LENTON includes a long female internally cylindrically threaded end member and a male externally cylindrically threaded connector end member, both of which are taper thread connected to the joined ends of reinforcing bar. A jam or lock nut is positioned on the threads of the male connector end and must be tightened against the female long end after the male and female ends are properly secured and tightened on the respective bars.

Position couplers, while quite adequate for the intended purpose, present some field installation problems. The male and female ends are of course rotated in the opposite directions for tightening and when the jam nut is tightened it is rotated on the cylindrical threads of the connector end in a direction which may tend to loosen the connector end taper threaded connection to its bar. Position couplers normally require torquing of at least some of the parts in opposite directions. If rotational slippage occurs, the connector end may require retightening and/or being held by a second wrench during the tightening of the jam nut. Since the field installation of such position couplers is not like working at a bench with a vise, a slippage problem can reduce the productivity of the installer.

In machined thread couplers, because of imperfect thread flank contact, when the coupling is placed under tension some axial slippage also may occur. Thus if flank contact can be improved when the coupling is formed, such axial slippage can be minimized.

Also, with prior position couplers, if the coupler is to be used as a connection socket abutting the form of a pour or in precast concrete, it is necessary to disassemble the coupler and cast in only the female portion of the coupler joined to a rod in the pour. In a pour there may be a considerable time lag after the pour before the form is removed and the complete connection is made. There is an even longer time period in precast construction between the casting and erection and assembly, wherein the coupling will be completed. Storing the remaining or male part of the coupling during such interval is a major problem particularly at a complex construction site. Anytime something has to be disassembled for use problems and delays can result. It would therefore be beneficial if the coupling and all its parts could be totally self-contained within a cylindrical sleeve so that disassembly of the parts would not be required.

SUMMARY OF THE INVENTION

A position coupler for connecting reinforcing bar in concrete construction where neither bar is able to rotate either conveniently or not at all includes a sleeve at least a portion of which is internally cylindrically threaded and which receives at least one split collar insert. The insert has external cylindrical threads which match the internal cylindrical threads of the sleeve and also has internal tapered threads which match the tapered external threads on the bars to be joined. The inserts, in addition to being longitudinally split are provided with either a transverse slot or a hex head on their outer ends to receive a wrench. When a transverse slot is provided a spanner wrench may be inserted between the bar and sleeve. The tightening of the insert creates a wedge action which hoop stresses the sleeve locking the parts together and reduces slippage. The insert may be locked anywhere along the interior of the cylindrical thread portion of the sleeve to connect bars at different axial spacings. In a preferred form the sleeve is machined from stock with the cylindrical threads receiving the insert being formed on one end while the opposite end is provided with a taper thread socket having taper threads which match the external tapered threads of the bars to be joined. In another embodiment the sleeve is formed of tube with the internal cylindrical threads extending the length of the sleeve and an insert for each bar is employed. The sleeve may be provided with opposite hand threads so that rotation of the sleeve will draw the rods together before the inserts are fully torqued and locked.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

DETAILED DESCRIPTION OF THE PREFERRED EMBODIMENTS

Figure 1:
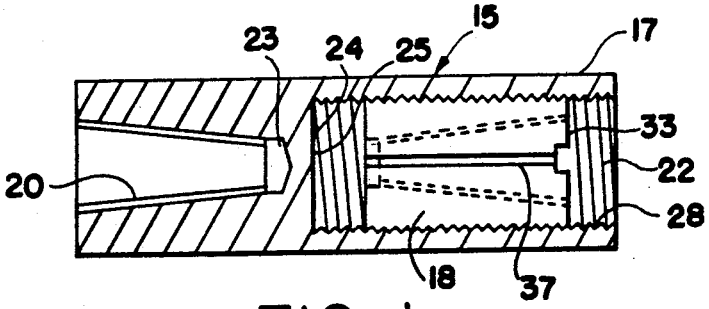
FIG. 1 is a longitudinal section of a position coupler in accordance with the present invention.

Referring first to FIG. 1 there is illustrated a position coupler in accordance with the present invention shown generally at 15 which includes a sleeve shown generally at 17 and a threaded collar insert shown generally at 18. The sleeve 17 may be circularly cylindrical or include a hexagonal outer configuration for the application of a wrench and at one end includes a taper threaded socket 20. At the opposite end the sleeve includes a cylindrical threaded socket 22 which is somewhat axially longer than the taper threaded socket. The blind end of the taper thread socket indicated at 23 is unthreaded and slightly spaced from the blind end 24 of the socket 22 forming a wall 25. The unthreaded portion 23 may of course be omitted.

Figure 3:
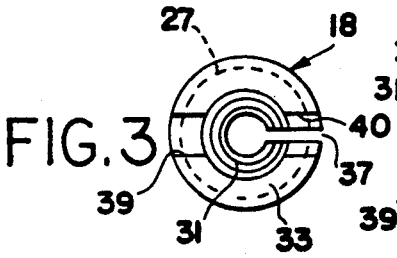
FIG. 3 is an end elevation of the split collar insert as would be seen from the right hand side of FIGS. 1 and 2.
Figure 4:
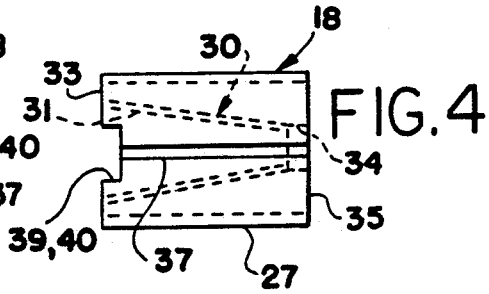
FIG. 4 is a side elevation of the split collar insert as seen from the right hand side of FIG. 3.

The insert 18 shown in more detail in FIGS. 3 and 4 is cylindrical in configuration and includes external cylindrical threads 27 which match the internal cylindrical threads 28 of the socket 22. The insert has an axial length substantially shorter than the axial length of the socket 22. The interior of the insert includes a taper thread section 30 which has tapered threads 31 which may be the same as the tapered threads of socket 20. If the position coupler is also a transition coupler the tapered threads of the insert may be of a different size matching the bar to be joined. The enlarged end of the tapered thread section terminates at the outer end face 33 of the collar insert while the inner or narrow end terminates at the end of smaller diameter cylindrical hole 34. The cylindrical hole continues to the inner end face 35 of the insert. The collar insert is longitudinally slit along one side as indicated by the slot 37. The outer end face is provided with diametral face slot sections 39 and 40.

Figure 2:
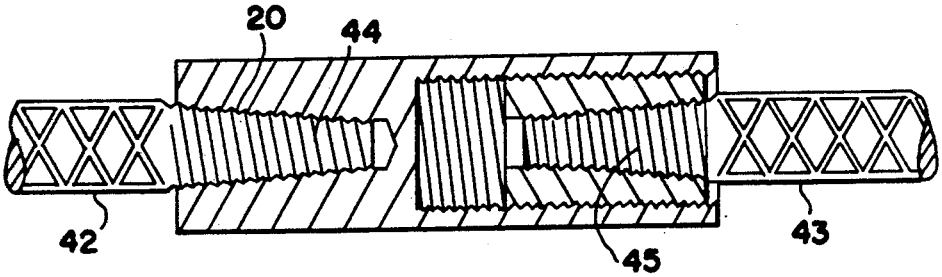
FIG. 2 is a similar section of a reinforcing bar joint formed with the position coupler of the present invention.

As seen in FIG. 2 the ends of reinforcing bars seen at 42 and 43 are provided with externally taper threaded end sections 44 and 45 respectively which match the internal tapered threads in the socket 20 and also in the split collar insert. Such tapered threads may be formed, for example, on a machine as shown in U.S. Pat. No. 4,526,496 to Anton M. Kies et al.

Figure 9:
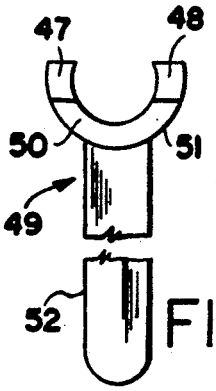
FIG. 9 is an end view of the spanner wrench of FIG. 8.
Figure 8:
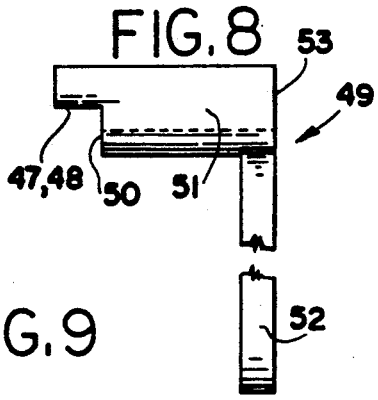
FIG. 8 is a plan illustration of a spanner wrench which may be used to tighten the inserts.

The slots 39 and 40 in the outer end face of the insert are adapted to receive the fingers 47 and 48 of a spanner wrench 49 shown generally in FIGS. 8 and 9. The fingers 47 and 48 project axially from one end 50 of semicylindrical body 51 and handle 52 projects radially from the other end 53. In this manner the spanner wrench may be inserted in the interior of socket 22 surrounding the bar 43 with the fingers 47 and 48 engaging the diametral slots 39 and 40 of the collar insert so that the collar insert may be turned with respect to both the sleeve 17 and bar 43. It will be appreciated that other types of spanner wrenches may be employed including those of the ratchet type and also those which indicate torque loading. In this manner, the joint shown in FIG. 2 may be formed by first tightening the sleeve 17 on the bar 42 and then rotating the insert with the spanner wrench, in a direction to unscrew it from the socket 22, which then tightens the internal threads of the insert on the threaded section of the bar 43. In this manner neither bar is required to rotate. The tightening of the insert causes the insert to expand slightly creating hoop stresses in the cylindrical threaded section of the sleeve locking the sleeve, insert and bar together. This of course minimizes axial slip when the joint is under tension.

Figure 6:
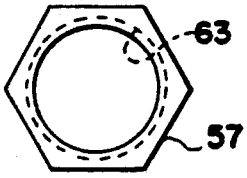
FIG. 6 is an end elevation of the seamless internally threaded sleeve of FIG. 5.
Figure 7:
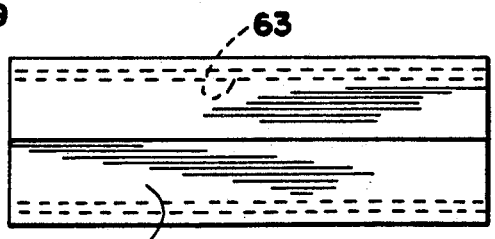
FIG. 7 is a side elevation of such sleeve.

The embodiment of FIGS. 1–4 comprises but two parts, namely the sleeve and one assembled collar insert. However, the position coupler 56 of FIG. 5 comprises three parts which are an elongated seamless internally threaded sleeve 57 and split collar inserts 58 and 59 for respective taper threaded bars 60 and 61. The split collar inserts 58 and 59 may be identical each having external cylindrical threads matching the internal cylindrical threads 63 in the sleeve, and each having internal tapered threads matching the tapered thread end sections 64 and 65 on the respective rods. The outer ends of each insert are also provided with the diametral slots seen at 66 and 67 for engagement by the spanner wrench. As illustrated in FIGS. 6 and 7 the sleeve 57 may also have a hexagonal exterior configuration.

Figure 5:
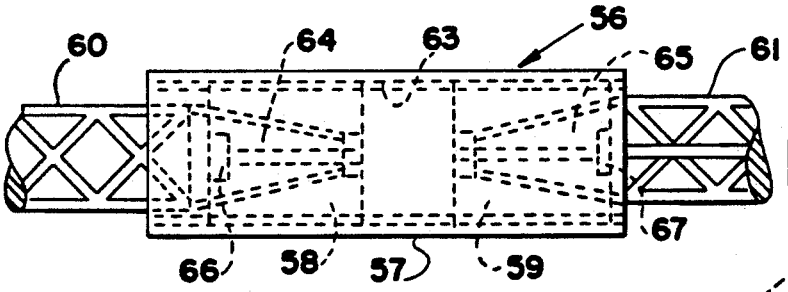
FIG. 5 is a side elevation of another form of position coupler in accordance with the present invention with the connected bars broken away.

In the embodiment of FIG. 5 the threads 63 on the interior of the sleeve 57 may be all of one hand with the threads on the exterior of the collar inserts being matching. To assemble the position coupler shown in FIG. 5 the inserts are threaded into the sleeve at the desired location. Then to assemble the split collar insert 58 onto the threaded section 64 of the bar 60 the insert is rotated in a counterclockwise direction facing the lefthand end of the sleeve in FIG. 5. This assembles the insert on the rod 60. Before the insert is fully tightened, the position of the insert in the sleeve may be adjusted by rotating the sleeve with respect to the insert. At the desired position the insert may then be fully torqued and because of its ability slightly to expand the insert sleeve and bar 60 will be locked together. The sleeve will of course be hoop stressed in the area of the insert 58.

The insert 59 may then be assembled on the rod 61 by rotating the insert 59 in a counterclockwise direction as viewed from the righthand end of the sleeve in FIG. 5. Because of the nature of the inserts, when the insert 59 is fully torqued, any tendency of the sleeve to rotate will be minimized. Also, when fully torqued better thread flank engagement is achieved which minimizes any axial slip tendency under tensile load.

Figure 10:
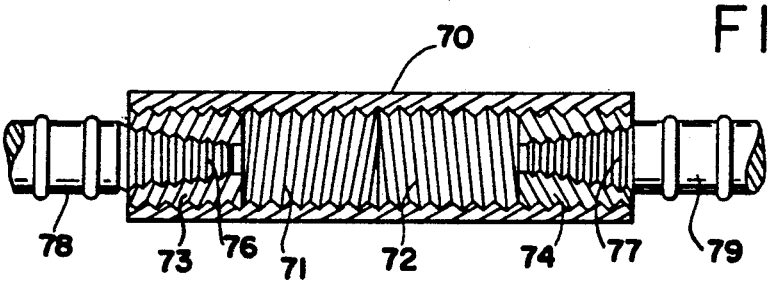
FIG. 10 is a view similar to FIG. 5 but broken away illustrating a form of position coupler using right and lefthand threads.

Referring now to FIG. 10 there is illustrated another form of the present invention utilizing sleeve 70 which may have a cylindrical or hexagonal external configuration and which is internally threaded with opposite hand threads as indicated at 71 and 72. The opposite hand threads extend for half the length of the sleeve. Inserts 73 and 74 of the same split and notched construction as the inserts 58 and 59 are threaded on the tapered thread sections 76 and 77 on the ends of respective reinforcing bars 78 and 79. Such inserts have external threads matching the opposite hand threads of the sleeve. In the embodiment of FIG. 10, before the inserts 73 and 74 are fully torqued and locked, the sleeve 70 may be rotated with respect to the inserts to draw the two bars 78 and 79 toward each other, or for that matter to move them apart. When the desired spacing is obtained the inserts are fully torqued locking the parts together.

Figure 12:
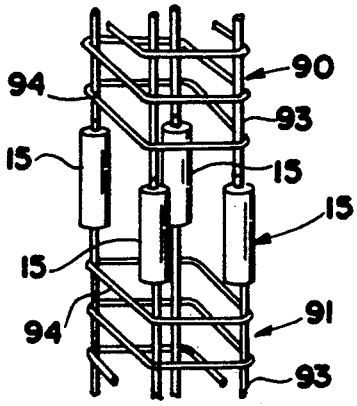
FIG. 12 is a broken perspective illustration of the position couplers of the present invention being used to join rods in a cage.
Figure 11:
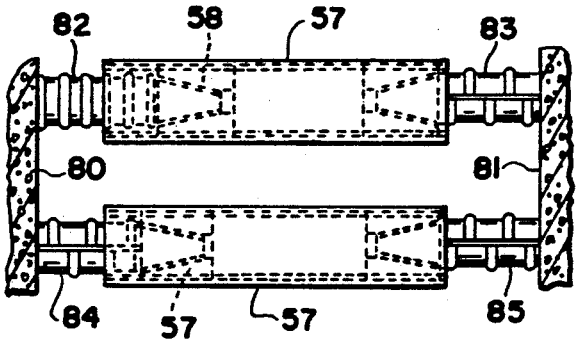
FIG. 11 is an illustration on a reduced scale of the position coupler being employed to join projecting rod from precast concrete where the joined rod ends are differently spaced.

Referring now to FIGS. 11 and 12 there are illustrated various applications for position couplers in accordance with the present invention. In FIG. 11 two precast or cast concrete elements illustrated at 80 and 81 which include opposed projecting reinforcing or dowel rods 82, 83, 84 and 85, each of which includes a taper thread end section. It should be noted however that the rod 82 projecting from the element 80 extends further than the rod 84 so that the spacing between the rods 82 and 83 is less than the spacing between the rods 84 and 85. Regardless of such spacing differential, the rods can be joined with the position couplers of the present invention. The only difference between the two joints illustrated in FIG. 11 is that the insert 58 secured to the taper thread section of the rod 82 is positioned further inwardly from the end of the sleeve 57. Although the embodiment of FIG. 5 has been illustrated in FIG. 11 it will be appreciated that the two-part embodiment of FIG. 1 may equally well be employed since the single insert 18 may be adjustably positioned anywhere along the internally cylindrically threaded socket 22 thus accommodating bar ends differently axially spaced.

In FIG. 12 there is illustrated a typical column cage wherein the position couplers or joints of the present invention are employed to join the vertically extending reinforcing rod of top and bottom cage sections 90 and 91. The vertically extending rods of such cages indicated generally at 93 are normally wire tied to rod 94 and thus the rods 93 in the sections cannot normally be rotated after the cage sections are formed. Also, the axial spacing of the rods may not in each instance be the same. In any event the joining of rods in cage sections presents an ideal application for the position coupler of the present invention.

Figure 13:
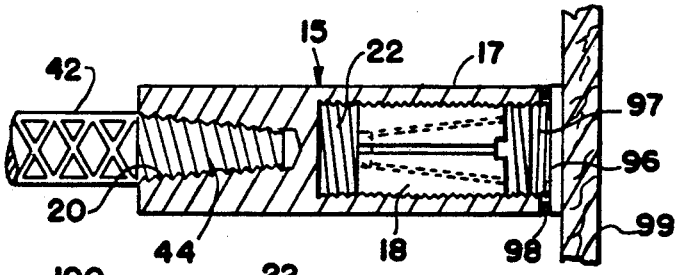
FIG. 13 is an illustration of the position coupler of FIG. 1 capped on one end and positioned against a form.
Figure 14:
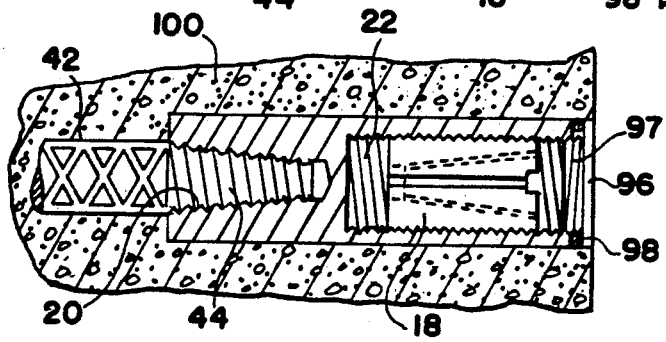
FIG. 14 is an illustration of the position coupler of FIG. 13 embedded in concrete with the cap exposed so that on removal a continuation of the bar may be formed.

With reference to FIGS. 13 and 14 there is illustrated a position coupler in accordance with the present invention used as a connection socket in the formation of a pour or a precast concrete element. In FIG. 13 the position coupler sleeve 17 is threaded on taper threaded end section 44 of rod 42 and tightened. The insert 18 is assembled in the cylindrical thread socket 22 and a cap 96 having a few external threads 97 on a short projecting stud is threaded in the end of the socket compressing O-ring seal 98. The seal keeps concrete out of the socket when the concrete is poured. The end cap is abutted against form 99 and the concrete 100 is poured. When the form 99 is removed the end cap is exposed. The insert may then be used to attach a rod to the position coupler in a continuing pour. In a precast section the position coupler forms a recessed rod or dowell attachment connection. In this manner disassembly of the insert is not required.

Figure 15:
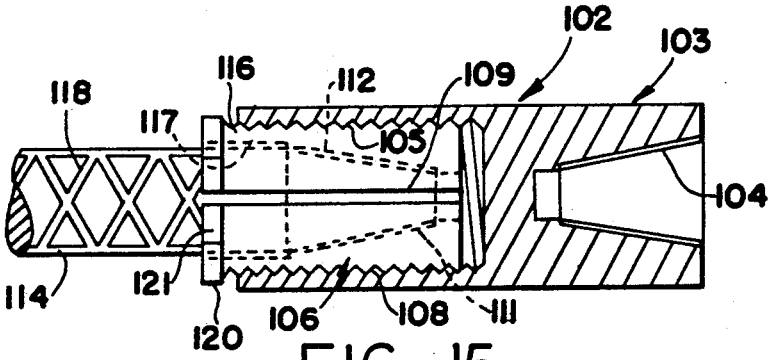
FIG. 15 is a side elevation partly in section of a position coupler also in accordance with the present invention but using a projecting hex head for rotation of the split insert.
Figure 16:
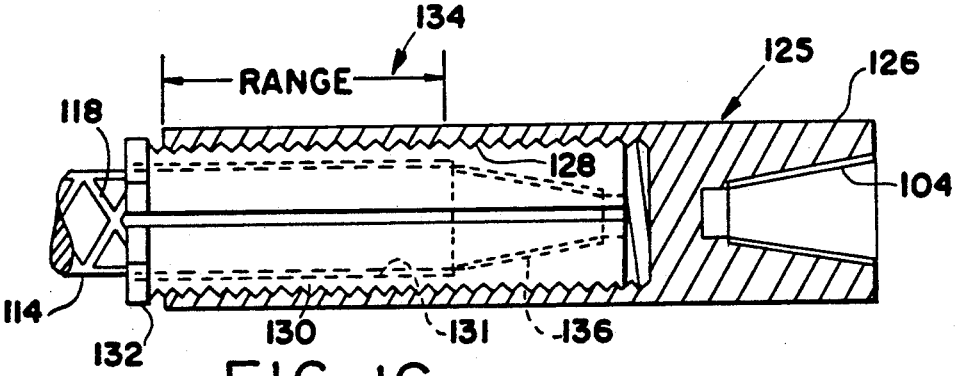
FIG. 16 is an illustration of a similar position coupler but of extended length to accommodate a range of axial spacing.
Figure 17:
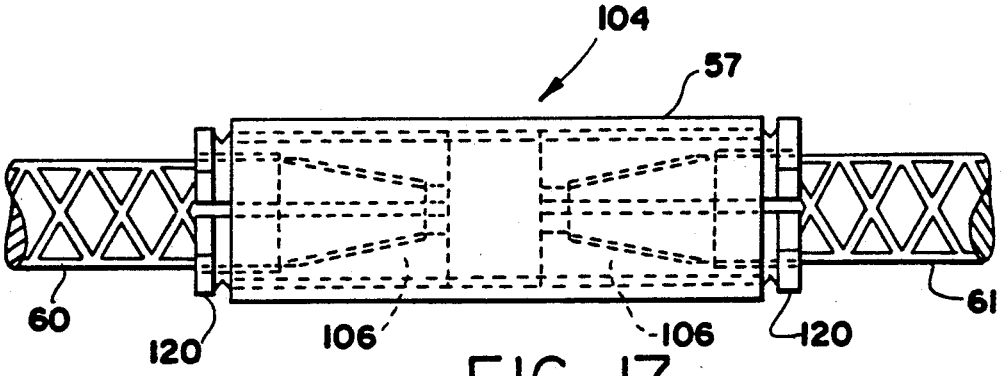
FIG. 17 is an illustration of a position coupler using a hex head insert for both bars.

With reference to FIGS. 15–17, it will be seen that position couplers in accordance with the present invention can be formed with split collar inserts which include an axially extending radially projecting hexagonal or flatted head so that the insert can be turned with a more conventional wrench rather than a spanner wrench as seen in FIGS. 8 and 9.

As seen in FIG. 15 the position coupler shown generally at 102 includes a sleeve 103 which may be essentially the same as the sleeve 17 of FIG. 1. The sleeve includes at one end a taper internally threaded socket 104 to receive the taper externally threaded end of a reinforcing bar (not shown) in the same manner as in FIG. 2. The opposite end of the sleeve is provided with an internally cylindrically threaded socket 105 which receives split collar insert 106. The insert is provided with external cylindrical threads 108 matching the threads of socket 105 and is longitudinally split as indicated by the slot 109. The interior of the insert includes tapered internal threads 111 matching the tapered external threads 112 on the end of rod 114. Outwardly of the internally tapered threaded section the insert includes an axial extension 116 which has a slightly enlarged internal diameter 117 which radially clears the external ribs 118 on the reinforcing bar 114. The outer end of the insert includes a radially projecting flange 120 which may be provided with a hexagonal configuration providing flats 12 for engagement by a conventional wrench.

While the position coupler 102 of FIG. 15 provides limited variations in the axial spacing of the connected rods, it will be appreciated that substantial axial spacing variation may be obtained simply by lengthening the cylindrically threaded socket of the sleeve and the axial extension of the insert. As seen in FIG. 16 the coupler 125 has a sleeve 126 with an axially lengthened cylindrical internally threaded socket 128. The split insert is provided with a lengthened extension 130 which has an enlarged internal diameter 131 clearing the ribs 118 of rod 114, and which terminates in radially extending flatted wrench engaging head 132. The insert and sleeve are connected to the respective rods in the same manner but the coupling of FIG. 16 has a lengthened range of adjustment as indicated at 134 to accommodate axial spacing variations of the rods. While the insert of the illustrated coupler has external threads throughout its length, it will be appreciated that the external threads need only be axially coextensive with the tapered internal thread section 136. In such case the outside diameter of the extension 130 should be such as to clear the internal threads of socket 128.

In FIG. 17 there is illustrated a position coupler 140 which is like that shown in FIG. 5 but which, while using sleeve 57, has split collar inserts 106 of the type shown in FIG. 15 in each end. In fact in some instances the two different types of inserts may be used interchangeably with the same sleeve. In the FIG. 17 embodiment the inserts are turned with conventional wrenches with the projecting flatted heads 120. The lengths of the sleeve as well as the inserts may vary. Also the inserts 106 may of course be used with the turnbuckle coupler of FIG. 10.

It will be appreciated that a wide variety of thread forms and taper angles may be used with the present invention. Normally, the length of the insert may vary depending on the taper angle. The insert should be somewhat longer than the taper threaded end section of the bar so that the hoop stress of the sleeve is generated uniformly for the full length of the taper threaded end section of the rod.

It can now be seen that there is provided a low cost and easy to use position coupler for concrete reinforcing bar which minimizes slip found in prior art systems and which is easy to install.

Although the invention has been shown and described with respect to certain preferred embodiments, it is obvious that equivalent alterations and modifications will occur to others skilled in the art upon the reading and understanding of this specification. The present invention includes all such equivalent alterations and modifications, and is limited only by the scope of the following claims.

What is claimed is:

1. A coupler for concrete reinforcing bar and the like comprising a sleeve having internal cylindrical threads, a radially expansible axially slit collar insert in said sleeve in threaded engagement with the internal threads of said sleeve, and tapered internal threads on said insert adapted to be threaded onto tapered external threads on the opposite ends of such bar, the area of cylindrical threaded engagement between the insert and sleeve substantially enclosing the area of tapered threaded engagement between the insert and bar wherein the internal threads of the sleeve and the external threads of the insert, and the internal tapered threads of the insert and the external tapered threads of the bar match whereby the insert may be rotated in the sleeve while the insert simultaneously engages the taper thread of the bar.

2. A coupler as set forth in claim 1, said insert having an outer end and including means on the outer end of said insert adapted to be engaged by a wrench and the like.

3. A coupler as set forth in claim 2 wherein said means on the outer end of said insert comprises a diametral transverse slot adapted to be engaged by a spanner wrench and the like.

4. A coupler as set forth in claim 2 including flatted means on the outer end of said insert and wherein said flatted means comprises a radially projecting head adapted to be engaged by a wrench and the like.

5. A coupler as set forth in claim 4 wherein said flatted head is positioned at the outer end of an axial extension of said insert which includes an enlarged internal diameter providing radial clearance for ribs on the connected reinforcing bar.

6. A coupler as set forth in claim 1 wherein said slit collar insert has an axial length and includes a single slot extending the axial length thereof to enable said insert to expand when tightened on the tapered thread of the rod and hoop stress said sleeve in the area of said insert.

7. A coupler as set forth in claim 1 wherein the internal threads on said sleeve extend throughout the axial length thereof and there are inserts in both ends of the sleeve.

8. A coupler as set forth in claim 7 wherein the internal threads on said sleeve are of opposite hand at each end.

9. A coupler as set forth in claim 1 wherein said sleeve includes a taper thread socket at one end to receive the tapered threads on the end of one bar, and internal cylindrical threads at the opposite end to receive said insert.

10. A coupler as set forth in claim 9 including a transverse wall between said tapered thread socket and said cylindrical threads.

11. A coupler as set forth in claim 1 wherein the insert is adapted for expanding action when the internal tapered threads of the insert engage the external tapered threads of the bar and forces the insert to expand, the internal cylindrical threads having flanks and such expansion forcing the flanks of the internal cylindrical threads of the sleeve and the external cylindrical threads of the insert into intimate contact to remove substantially all play between such threads to resist reversal of load without slip.

12. A concrete structure comprising a body of concrete having an end face, a first reinforcing bar embedded in the concrete body and having a tapered thread section on its end, a sleeve having internal threads, one end threadedly secured to the tapered thread section of said first reinforcing bar while the opposite end is flush with said end face, said sleeve, except for its said opposite end also being embedded in said concrete body, and a radially expansible axially slit collar insert in said sleeve in threaded engagement with the internal threads of said sleeve, and tapered internal threads on said insert, said sleeve substantially enclosing said insert, said sleeve and insert forming a socket in which a second reinforcing bar having a tapered end thread section may be inserted and secured wherein the internal threads of the sleeve and the external threads of the insert, and the internal tapered threads of the insert and the external tapered threads of the bar match whereby the insert may be rotated in the sleeve while the insert simultaneously engages the taper thread of the bar.

13. A concrete structure as set forth in claim 12 including means on the outer end of said insert adapted to be engaged by a spanner wrench and the like.

14. A concrete structure as set forth in claim 13 wherein said means on the outer end of said other insert comprises a diametral transverse slot.

15. A concrete structure as set forth in claim 12 wherein said split collar insert includes a single slot extending the axial length thereof to enable said insert to expand when tightened on tapered thread of the rod and hoop stress said sleeve in the area of said insert.

16. A concrete structure as set forth in claim 12 wherein said sleeve includes a taper thread socket at one end to receive the tapered threads on the end of one bar, and internal cylindrical threads at the opposite end to receive said insert.

17. A concrete structure as set forth in claim 16 including a transverse wall between said tapered thread socket and said cylindrical threads.

18. A concrete structure as set forth in claim 16 including a removable cap secured to the opposite end of said socket to seal the cylindrical threads and insert therein against concrete intrusion.

* * * * *